US005290336A

United States Patent [19]

Luk

[11] Patent Number: 5,290,336

[45] Date of Patent: Mar. 1, 1994

[54] IRON-BASED POWDER COMPOSITIONS CONTAINING NOVEL BINDER/LUBRICANTS

[75] Inventor: Sydney Luk, Lafayette Hill, Pa.

[73] Assignee: Hoeganaes Corporation, Riverton, N.J.

[21] Appl. No.: 878,032

[22] Filed: May 4, 1992

[51] Int. Cl.[5] ..... C22C 29/00

[52] U.S. Cl. ..... 75/231; 75/246; 75/252; 252/52 A; 252/56 D

[58] Field of Search ..... 75/231, 246, 252; 252/56 D, 52 A; 419/10, 38

[56] References Cited

U.S. PATENT DOCUMENTS

| | | | |
|---|---|---|---|
| 3,154,514 | 10/1964 | Kelly | 524/375 |
| 3,297,571 | 1/1967 | Bonis | 75/230 |
| 3,410,684 | 11/1968 | Printz | 419/2 |
| 3,577,226 | 5/1971 | Elbert et al. | 428/566 |
| 3,836,355 | 9/1974 | Lindskog et al. | 75/252 |
| 4,047,983 | 9/1977 | Falkowski et al. | 148/105 |
| 4,106,932 | 8/1978 | Blachford | 252/10 |
| 4,108,785 | 8/1978 | Sturwold | 252/56 R |
| 4,115,158 | 9/1978 | Reen | 148/100 |
| 4,190,441 | 2/1980 | Tengzelius et al. | 75/255 |
| 4,199,460 | 4/1980 | Sumrell et al. | 252/46.7 |
| 4,362,559 | 12/1982 | Perez et al. | 75/53 |
| 4,483,905 | 11/1984 | Engstrom | 428/570 |
| 4,735,734 | 4/1988 | Staub et al. | 252/29 |
| 4,834,800 | 5/1989 | Semel | 106/403 |
| 5,098,942 | 3/1992 | Menke et al. | 524/314 |
| 5,125,990 | 6/1992 | Iwasaki et al. | 148/302 |

FOREIGN PATENT DOCUMENTS

| | | |
|---|---|---|
| 0329475 | 8/1989 | European Pat. Off. . |
| 1119605 | 5/1989 | Japan . |

OTHER PUBLICATIONS

CARBOWAX ® Polyethylene Glycols, Product Information Bulletin, 1986, Union Carbide Corporation.

Okabe, et al. *A Study on Friction-polymer Type Additives,* Proc. of the JSLE Intl. Tribology Conference, 1985, Tokyo.

Masuko, et al., *Anti-wear properties of hydroxycarboxylic acids with straight alkyl chains,* Triboloby Intl.

*List of trade names and manufacturers of placticizers, Placticizers,* 288.

*Primary Examiner*—Donald P. Walsh

*Assistant Examiner*—Ngoclan T. Mai

*Attorney, Agent, or Firm*—Woodcock Washburn Kurtz Mackiewicz & Norris

[57] ABSTRACT

Iron-based metallurgical powder compositions are produced by mixing iron-based powder with an improved binder/lubricant that comprises dibasic organic acid and one or more additional components such as solid polyethers, liquid polyethers, and acrylic resin. These novel binder/lubricants impart one or more enhanced green properties to the powder compositions and reduce the ejection force required to remove the compositions from molds and dies.

32 Claims, No Drawings

IRON-BASED POWDER COMPOSITIONS CONTAINING NOVEL BINDER/LUBRICANTS

FIELD OF THE INVENTION

This invention relates to iron-based, metallurgical powder compositions and, more particularly, to powder compositions which include an improved binder/lubricant.

BACKGROUND OF THE INVENTION

The use of powder metallurgical techniques in the production of metal parts is well established. Such techniques typically involve mixing iron-based powders with an allowing element such as graphite, copper, or nickel in powder form, compacting the mixture in a die, ejecting the compact from the die, and sintering of the compact. The presence of the alloying element permits the attainment of strength and other mechanical properties in the sintered part which could not be reached with iron-based powders alone.

The alloying ingredients which normally are used in iron-based powder mixtures typically differ from the basic iron-based in particle size, shape, and density. For example, the average particle size of the iron-based powders used in the manufacture of sintered metal parts is typically about 25–150 microns. In contrast, the average particle size of most alloying ingredients used in conjunction with the iron-based powders is less than about 75 microns and often less than about 20 microns. Alloying powders are used in such a finely-divided state to promote rapid homogenization of the alloy ingredients by solid state diffusion during the sintering operation. However, this extremely fine size, together with the overall differences between the iron-based and alloying powders in particle size, shape, and density, make these powder mixtures susceptible to the undesirable separatory phenomena of segregation and dusting. Binding agents frequently are added to bond the powder particles and reduce the segregation. For example, U.S. Pat. No. 4,834,800, in the name of Semel, discloses certain water-insoluble resins as binding agents.

Lubricants can also be admixed with a powder blend to reduce internal friction between particles during compaction, to permit easier ejection of the compact from the die cavity, to reduce die wear, and/or to allow more uniform compaction of the blend. Common lubricants include solids such as metallic stearates or synthetic waxes. U.S. Pat. No. 4,106,932, in the name of Blanchford, discloses the use of certain liquid lubricants in microencapsulated form.

As will be recognized, most known lubricants reduce the green strength of the compact. It is believed that during compaction the lubricant is exuded between iron and/or alloying particles such that it fills the pore volume between the particles and interferes with particle/-particle bonding. Indeed, some shapes cannot be pressed using known lubricants. Tall, thin-walled bushings, for example, require large amounts of lubricant to overcome die wall friction and reduce the required ejection force. Such levels of lubricant, however, typically reduce green strength to the point that the resulting compacts crumble upon ejection. To avoid these problems, it is known to spray the die wall with lubricant rather than to incorporate the lubricant into the powder composition. However, spraying the lubricant increases the compaction cycle time and leads to less uniform compaction. Also, lubricants such as zinc stearate often adversely affect powder flow rate and apparent density, as well as green density of the compact, particularly at higher compaction pressures. Moreover, excessive lubricant can lead to compacts having poor dimensional integrity, and volatized lubricant can form soot on the heating elements of a furnace.

Accordingly, there exists a need in the art for metallurgical powder compositions that are resistant to dusting and segregation and that can be readily compacted to strong green parts that are easily ejected from die cavities.

SUMMARY OF THE INVENTION

The present invention provides iron-based metallurgical powder compositions which are produced by mechanically mixing iron-based powder and, optionally, alloying powder with an improved binder/lubricant. The binder/lubricant comprises dibasic organic acid and one or more additional polar components such as polyethers and acrylic resins. In preferred embodiments, the binder/lubricants comprise: dibasic acid and a polyether that is solid under ambient conditions; dibasic acid, solid polyether, and a polyether that is liquid under ambient conditions; dibasic acid, solid polyether, liquid polyether, and acrylic resin; dibasic acid, solid polyether, and acrylic resin; or dibasic acid, liquid polyether, and acrylic resin.

These novel binder/lubricants enhance one or more physical properties of the powder mixture such as apparent density, flow, compressibility, and green strength. Since compacts made from the present powder compositions require less force for ejection from molds and dies, there is less wear and tear on tooling. Furthermore, the compositions can be compacted into complex shapes that were not previously attainable by powder metallurgical techniques.

DETAILED DESCRIPTION OF THE INVENTION

The metallurgical powder compositions of the present invention generally are prepared by mixing iron-based powder with a binder/lubricant. The iron-based powders that are useful in the invention are any of the pure iron or iron-containing (including steel or ferromagnetic) powders generally used in powder metallurgical methods. Examples are powders of substantially pure iron and powders of iron pre-alloyed with other elements (for example, steel-producing elements) that enhance the strength, hardenability, electromagnetic properties, or other desirable properties of the final product. The powders of iron-based material useful in this invention can have a weight average particle size as small as one micron or below, or up to about 850–1000 microns, but generally the particles will have a weight average particle size in the range of about 10–500 microns. Preferred are powder compositions having a maximum average particle size of about 150 microns, and more preferred are powder compositions having a maximum average particle size of about 100 microns.

The preferred iron-based powders for use in the invention are highly compressible powders of substantially pure iron; that is, iron containing not more than about 1.0% by weight, preferably no more than about 0.5% by weight, of normal impurities. Examples of such metallurgical grade pure iron powders are the ANCORSTEEL 1000 series of iron powders available from Hoeganaes Corporation, Riverton, N.J. A particularly preferred such powder is ANCORSTEEL 1000C iron powder, which has a typical screen profile of about 13% by weight of the particles below a No. 325 sieve and about 17% by weight of the particles larger than a No. 100 sieve, with the remainder between these two sizes (trace amounts of larger than No. 60 sieve). The ANCORSTEEL 1000C powder has an apparent density of from about 2.8 to about 3.0 g/cm$^2$.

Other iron-based powders that are useful in the practice of the invention are ferromagnetic or steel powders containing effective amounts of alloying elements pre-alloyed with the iron. Examples of good ferromagnetic materials are particles of iron that has been pre-alloyed with phosphorous and blends of such pre-alloyed iron powders with particles of substantially pure iron, such as disclosed in U.S. Pat. Nos. 3,836,355 and 4,190,441, both in the name of Tengzelius, et al.. Examples of steel powders are particles of iron pre-alloyed with one or more transition elements or other fortifying elements, such as molybdenum, nickel, manganese, copper, and chromium. Suitable steel powders are available from Hoeganaes Corp. as part of its ANCORSTEEL line of pre-alloyed iron powders.

In certain embodiments, the powder compositions comprise an alloying powder in addition to the unalloyed or partially alloyed iron powders. For purposes of the present invention, the term "alloying powder" refers to any particulate element or compound added to the iron-based powder, whether or not that element or compound is ultimately alloyed with the iron-based powder after pressing and sintering. Non-limiting examples of alloying powders are metallurgical carbon, in the form of graphite; elemental nickel, copper, molybdenum, sulfur, or tin; binary alloys of copper with tin or phosphorus; ferro-alloys of manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; aluminum oxide; and sulfides of manganese or molybdenum. In general, the total amount of alloying powder present is minor, on the order of from about 0.01 to about 3% of the total composition weight, although as much as 10–15% by weight can be present for certain specialized powders.

In accordance with the invention, iron-based powder and, preferably, alloying powder are mixed with a binder/lubricant of the invention which comprises dibasic organic acid and one or more additional polar components. It will be recognized that the term "dibasic organic acid" includes all dicarboxylic derivatives of aliphatic hydrocarbons having at least two carboxylic groups. Preferred dibasic organic acids have a formula:

$$HOOC—R_1—COOH$$

wherein $R_1$ is alkyl or alkenyl having from 1 to about 10 carbon atoms. Representative dibasic organic acids include oxalic, malonic, succinic, glutaric, adipic, pimelic, suberic, and sebacic acids. Azelaic acid is a preferred dibasic organic acid.

Certain of the present binder/lubricants further comprise a solid polyether, that is, a polyether that exists as a solid under ambient conditions (i.e., about 68° F. (20° C.) and about 760 Torr.). Solids according to the invention are materials that substantially maintain their shape and/or dimensions in the absence of a supportive or containing surface or substrate. Representative solid polyethers include compounds having more than one subunit of a formula:

$$—[O(CH_2)_q]—$$

wherein q is from about 1 to about 7. More preferred are solid polyethers having a formula:

$$H—[O(CH_2)_q]_n—OH$$

wherein q is from about 1 to about 7 and n is selected such that the polyether has a weight average molecular weight greater than 10,000 based on rheological measurements. Preferably, q is 2 and n is selected such that the polyether has a weight average molecular weight from about 2,000 to about 180,000 as determined by gel permeation chromatography (GPC); more preferably, q is 2 and the polyether has a weight average molecular weight of about 20,000 or about 100,000. The solid polyether preferably is substantially linear in structure and is an oriented polymer having a high degree of crystallinity, preferably as high as 95% crystallinity. It should burn cleanly in the sintering process to leave no ash. Preferred solid polyethers are the ethylene oxide derivatives generally disclosed in U.S. Pat. No. 3,154,514, in the name of Kelly. Particularly preferred are the CARBOWAX® 20M and POLYOX® N-10 resins, both of which are available from Union Carbide Corporation of Danbury, Conn.

In certain embodiments, the binder/lubricants of the invention comprise a liquid polyether in addition to, or instead of, the solid polyether. As used herein, a "liquid polyether" is one that exists as a liquid under ambient conditions, and "liquid" refers to substances which tend to flow or to conform to the outline of a support or container. Representative liquid polyethers include compounds having more than one subunit of a formula:

$$—[O(CH_2)_q]—$$

wherein q is from about 1 to about 7. Preferred liquid polyethers are polymers of glycerine, ethylene oxide, and propylene oxide having a weight average molecular weight less than about 8000 as determined by GPC. Liquid polyethers preferably have a weight average molecular weight between about 190 and about 630, more preferably about 400. Preferred liquid polyethers are available from Union Carbide Corporation and from Dow Chemical Corporation of Midland, Mich., See, e.g., CARBOWAX® Polyethylene Glycols, Product Information Bulletin, 1986, Union Carbide Corporation. Particularly preferred are polyglycol copolymers such as Polyglycol 15-200 (CAS #51259-15-2), available from Dow. The binder/lubricant of this invention can also contain an acrylic resin which contains polymers or copolymers of acrylic and/or methacrylic acid. Representative acrylic resins include compounds having more than one subunit of a formula:

$$—[CH_2—C(H)(R_2)—COOR_3]—$$

wherein $R_2$ is H or methyl, and $R_3$ is H, alkyl or alkenyl having from 1 to about 7 carbon atoms. In preferred embodiments, $R_2$ is H and $R_3$ is H, methyl, or butyl. The acrylic resin should be thermally stable (i.e., not degrade into lower molecular weight components) at temperatures up to about 350° F. and should burn cleanly during sintering to leave no ash. Preferred acrylic resins have weight average molecular weights of about 25,000 to about 350,000.

In certain embodiments, the binder/lubricants further comprise a plasticizer. Representative plasticizers, which are generally disclosed by R. Gachter and H. Muller, eds., Plastics Additives Handbook (1987) at, for example, pages 270–281 and 288–295, include esters alkyl, alkenyl, or aryl esters phthalic acid, phosphoric acid, and dibasic acid wherein the alkyl, alkenyl, and aryl moieties have from about i to about 10 carbon atoms, from about 1 to about 10 carbon atoms, and from about 6 to about 30 carbon atoms, respectively. Preferred esters are alkyl esters, such as di-2-ethylhexyl phthalate (DOP), di-iso-nonyl phthalate (DINP), dibutyl phthalate (DBP), trixylenyl phosphate (TCP), and di-2-ethylhexyl adipate (DOA). DBP and DOP are particularly preferred plasticizers.

The binder/lubricant can be mixed with the iron-based powder according to procedures taught by U.S. Pat. No. 4,483,905, the disclosures of which are hereby incorporated by reference. Generally, however, a dry mixture of the iron-based powder and alloying powder is made by conventional techniques, after which the binder/lubricant is added, preferably in liquid form, and thoroughly mixed with the powders. The mixture is then spread over a shallow tray and allowed to dry, occasionally with the aid of heat or vacuum. The components of the binder/lubricant that are in liquid form under ambient conditions can be added to the dry powder as such, although they preferably are first diluted in an organic solvent to provide better dispersion. Solid components are generally dissolved or dispersed in an organic solvent or medium and added in this liquid form. Solid components can, however, be very finely ground and dry blended with the admixed iron-based and alloying powders. While not wishing to be limited to any particular theory of the invention, it is believed that the polar binder/lubricants of the present invention form a polymeric complex on the surface of the iron powder.

The amount of binder/lubricant to be added to the powder composition depends on such factors as the density and particle size distribution of the iron-based powder and any alloying powder, and the relative weight of the powders in the composition. Generally, the binder/lubricant will constitute about 0.3–10.0 weight percent, preferably about 0.5–3.0 weight percent, most preferably about 0.8–1.2 weight percent, of the total powder composition. The binder/lubricant can comprise from about 1 to about 10 weight percent dibasic organic acid, from about 50 to about 90 weight percent solid polyether, from about 5 to about 50 weight percent liquid polyether, and from about 5 to about 50 weight percent acrylic resin. In certain preferred embodiments, the binder/lubricants comprise dibasic organic acid (about 1 to about 10 weight percent) and solid polyether (about 90 to about 99 weight percent). In other preferred embodiments, the binder/lubricants comprise dibasio acid (about 1 to about 10 weight percent), solid polyether (about 70 to about 99 weight percent), and liquid polyether (about 5 to about 30 weight percent). In further preferred embodiments, the binder/lubricants comprise dibasic acid (about 1 to about 10 weight percent), solid polyether (about 30 to about 50 weight percent), liquid polyether (about 10 to about 30 weight percent), and acrylic resin (about 30 to about 50 weight percent). In still further preferred embodiments, the binder/lubricants comprise dibasic organic acid (about i to about 10 weight percent), solid polyether (about 40 to about 50 weight percent), and acrylic resin (about 40 to about 50 weight percent). In other preferred embodiments, the binder/lubricants comprise dibasic organic acid (about 1 to about 10 weight percent), liquid polyether (about 10 to about 30 weight percent), and acrylic resin (about 70 to about 90 weight percent).

The following examples, which are not intended to be limiting, present certain embodiments and advantages of the present invention. Unless otherwise indicated, all percentages are by weight. In each of the examples, the iron-based powders and alloying powders were mixed in standard laboratory bottle-mixing equipment for 20–30 minutes. The resultant dry mixture was transferred to an appropriately-sized bowl of an ordinary food mixer. Care was taken throughout to avoid any dusting of the powder. The binder/lubricant components were then added to the powder mixture and blended with the powder with the aid of spatula. Blending was continued until the mixture had a uniform appearance. Thereafter, the mixture was spread on a shallow metal tray and allowed to dry. After drying, the mixture was coaxed through a 60-mesh screen to break up any large agglomerates which may have formed during the drying.

Dusting resistance was determined by elutriating a powder mixture with a controlled flow of nitrogen. The test apparatus consisted of a cylindrical glass tube vertically mounted on a two-liter Erlenmeyer flask equipped with a side port to receive the flow of nitrogen. The glass tube (17.5 cm in length; 2.5 cm inside diameter) was equipped with a 400-mesh screen plate positioned about 2.5 cm above the mouth of the Erlenmeyer flask. A 20–25 gram sample of the powder mixture to be tested was placed on the screen plate, and nitrogen was passed through the tube at a rate of 2 liters per minute for 15 minutes. At the conclusion of the test, the powder mixture was analyzed to determine the relative amount of alloying powder remaining in the mixture (expressed as a percentage of the before-test concentration of the alloying powder), which is a measure of the composition's resistance to loss of the alloying powder through dusting/segregation.

The powder mixtures were compacted into green bars in a die at a pressure of about 5–60 tsi (69–830 MPa), followed by sintering in a dissociated ammonia atmosphere for up to about 24 hours at temperatures of about 1000–1400° C. (1850°–2575° F.).

Physical properties of powder mixtures and of the green and sintered bars were determined generally in accordance with the following test methods and formulas:

| Property | Test Method |
|---|---|
| Apparent Density | ASTM B212-76 |
| Dimensional change | ASTM B610-76 |
| Flow | ASTM B213-77 |
| Green Density | ASTM B331-76 |
| Green Strength | ASTM B312-76 |
| Hardness | ASTM E18-84 |
| Sintered Density | ASTM B331-76 |
| Transverse Rupture Strength (TRS) | ASTM B528-76 |
| Green Expansion | |

$$\text{G.E. (\%)} = \frac{100[(\text{green bar length}) - (\text{die length})]}{\text{die length}}$$

Pore-free densities were calculated by summing up the product of the absolute density and weight percent for each ingredient in a powder mixture.

Strip pressure measures the static friction that must be overcome to initiate ejection of a compacted part from a die. It was calculated as the quotient of the load needed to start the ejection over the cross-sectional area of the part that is in contact with the die surface.

Slide pressure is a measure of the kinetic friction that must be overcome to continue the ejection of the part from the die cavity; it is calculated as the quotient of the average load observed as the part traverses the distance from the point of compaction to the mouth of the die, divided by the surface area of the part.

EXAMPLE 1

Comparison of Binder/Lubricant and Zinc Stearate On Iron Powder

Mixtures A-E, having the compositions indicated in Table I, were prepared as described above:

TABLE I

| Mix | A | B | C | D | E |
|---|---|---|---|---|---|
| Zinc Stearate[1] (%) | 0 | 0.25 | 0.50 | 0.75 | 1.0 |
| Binder/Lubricant[2] (%) | 0.75 | 0.50 | 0.25 | 0 | 0 |
| Graphite[3] (%) | 1.0 | 1.0 | 1.0 | 1.0 | 1.0 |
| Iron Powder[4] (%) | 98.25 | 98.25 | 98.25 | 98.25 | 98.25 |

[1]Mallinkrodt Flowmet Z, Mallinkrodt Specialty Chemical Co., St. Louis, MO.
[2]50% solid polyether (polyethylene oxide; M.W. = 20,000; (CARBOWAX ® 20M, Dow); 49.9% acrylic resin (copolymer of 85% butyl methacrylate and 15% methyl methacrylate (M.W. = 150,000 (wt. avg.); E.I. DuPont de Nemours,& Co., Inc., Wilmington, DE); 0.1% azelaic acid (Quantum Chemical Corp., Cincinnati, OH)
[3]Grade 3203HS, Ashbury Graphite Mill, Ashbury, NJ
[4]Ancorsteel 1000B; Hoeganaes The powder properties were as follows:

TABLE II

| Mix | A | B | C | D | E |
|---|---|---|---|---|---|
| Powder | | | | | |
| Dust Resistance (%) | 98.5 | 99.5 | 96.7 | 32 | 34 |
| Flow (sec/50 gr) | 25 | 24 | 22 | No | No |
| Apparent Density (g/cc) | 3.02 | 3.21 | 3.43 | 3.38 | 3.30 |

The mixtures were compacted in a TRS die (ASTM B213) with a carbide insert. The green properties of 0.5 inch TRS bars compacted to 50 tsi at 145° F. are shown in Table III.

TABLE III

| Mix | A | B | C | D | E |
|---|---|---|---|---|---|
| Green Density (g/cc) | 7.14 | 7.13 | 7.13 | 7.11 | 7.06 |
| Green Strength (psi) | 5400 | 3600 | 2400 | 1500 | 1500 |
| Strip Pressure (psi) | 2210 | 2900 | 3100 | 3000 | 2700 |
| Slide Pressure (psi) | 1660 | 2230 | 2550 | 2600 | 1840 |
| Pore-Free Density (g/cc) | 7.34 | 7.34 | 7.33 | 7.33 | 7.23 |
| % Pore-Free Density | 97.3 | 97.2 | 97.3 | 97.0 | 97.7 |

These results demonstrate that a powder mixture containing 0.75% of the binder/lubricant (Mix A) is superior to a powder mixture containing 0.75% of zinc stearate (Mix D) in terms of green density, green strength, sliding pressure, stripping pressure, and percentage theoretical pore-free density achieved. Bars formed from the powder mixture containing 0.75% binder/lubricant (Mix A) also possessed higher green density than bars formed from the mixture containing 1.0% zinc stearate (Mix E). The binder/lubricant is also compatible with zinc stearate, as indicated by the improved results of Mix B and Mix C when compared with zinc stearate alone (Mix D).

To test the sintering performance of the binder/lubricant, 0.25 inch TRS bars were pressed to 50 tsi and 145° F. and then sintered at 2050° F. at a rate of 2 inches/minute in a Lucifer Belt Furnace for 30 minutes under dissociated ammonia. The results are shown in Table IV.

TABLE IV

| Mix | A | B | C | D | E |
|---|---|---|---|---|---|
| Compacted | | | | | |
| Green Density (g/cc) | 7.15 | 7.15 | 7.13 | 7.12 | 7.07 |
| Green Expansion (%) | 0.27 | 0.23 | 0.21 | 0.27 | 0.26 |
| Strip Pressure (psi) | 2400 | 2300 | 2700 | 2800 | 2500 |
| Slide Pressure (psi) | 1300 | 1500 | 1800 | 1800 | 1300 |
| Sintered | | | | | |
| Density (g/cc) | 7.11 | 7.07 | 7.05 | 7.07 | 7.00 |
| Dimensional Change (%) | 0.28 | 0.31 | 0.30 | 0.32 | 0.30 |
| TRS (hsi) | 155 | 153 | 149 | 145 | 142 |
| Hardness ($R_B$) | 83.8 | 82.3 | 82.5 | 81.8 | 79.3 |

By reducing organic content from 1.0% to 0.75% (i.e., Mix E versus Mix A), the resultant sintered density is increased. Although the organic content has been reduced, the lubrication quality of 0.75% binder/lubricant is equivalent to 1.0% zinc stearate, as indicated by the stripping and sliding pressure data. Thus, the lubrication quality of the binder/lubricant appears to be superior to that of zinc stearate. Indeed, at an organic level of 0.75% (i.e., Mix A versus Mix D), the respective stripping and sliding pressures of zinc stearate are higher than for the binder/lubricant.

Test results for TRS bars compacted to 30, 40 and 50 tsi at 145° F. and then sintered at 2050° F. for 30 minutes in a Lucifer Belt Furnace under dissociated ammonia are shown in Table V.

TABLE V

| Mix | A | B | C | D | E |
|---|---|---|---|---|---|
| Compacted at 30 tsi | | | | | |
| Green Density (g/cc) | 6.74 | 6.73 | 6.73 | 6.75 | 6.76 |
| Green Strength (psi) | 3900 | 2600 | 1900 | 1200 | 1200 |
| Green Expansion (%) | 0.19 | 0.17 | 0.16 | 0.18 | 0.19 |
| Strip Pressure (psi) | 2200 | 2500 | 2900 | 2600 | 2300 |
| Slide Pressure (psi) | 1700 | 1500 | 2000 | 1600 | 1300 |
| Compacted at 40 tsi | | | | | |
| Green Density (g/cc) | 7.00 | 7.00 | 7.00 | 7.01 | 6.97 |
| Green Strength (psi) | 5000 | 3400 | 2300 | 1500 | 1500 |
| Green Expansion (%) | 0.24 | 0.20 | 0.20 | 0.21 | 0.23 |
| Strip Pressure (psi) | 2400 | 2700 | 3000 | 2900 | 2600 |
| Slide Pressure (psi) | 1500 | 1800 | 2100 | 2300 | 1800 |
| Compacted at 50 tsi | | | | | |
| Green Density (g/cc) | 7.14 | 7.13 | 7.13 | 7.11 | 7.06 |
| Green Strength (psi) | 5400 | 3600 | 2400 | 1500 | 1500 |
| Green Expansion (%) | 0.30 | 0.24 | 0.25 | 0.23 | 0.29 |
| Strip Pressure (psi) | 2600 | 2900 | 3000 | 3000 | 2700 |
| Slide Pressure (psi) | 1700 | 2200 | 2600 | 2600 | 1800 |
| Sintered | | | | | |
| Density (g/cc) | 6.74 | 6.73 | 6.74 | 6.73 | 6.73 |
| Dimensional Change (%) | 0.17 | 0.21 | 0.23 | 0.24 | 0.24 |
| TRS (hsi) | 120 | 121 | 119 | 116 | 118 |
| Hardness ($R_B$) | 72.7 | 72.3 | 71.8 | 70.6 | 71.3 |
| Carbon (%) | 0.90 | 0.87 | 0.88 | 0.90 | 0.89 |
| Oxygen (%) | 0.057 | 0.064 | 0.055 | 0.055 | 0.062 |

The trends observed for green density, green strength, stripping pressure, and sliding pressure indicate that the binder/lubricant is a better lubricant that zinc stearate.

EXAMPLE 2

Comparison of Binder/Lubricant And Synthetic Wax On Molybdenum/Iron Powder

Mixtures F–J, having the compositions indicated in Table VII, were prepared as described above:

TABLE VI

| Mix | F | G | H | I | J |
|---|---|---|---|---|---|
| Synthetic Wax[1] (%) | 0.75 | 0.75 | 0 | 0 | 0 |
| Binder/Lubricant[2] (%) | 0 | 0 | 0.75 | 0.50 | 0.25 |
| Regular Binding Agent (%) | 0 | 0.1 | 0 | 0 | 0 |
| Graphite[4] (%) | 0.6 | 0.6 | 0.6 | 0.6 | 0.6 |
| Iron-based Powder[5] (%) | 98.65 | 98.55 | 98.65 | 98.9 | 99.15 |

[1]Ethylene bistearimide; Acrawax TM, Lonza, Inc., Fair Lawn, NJ
[2]50% solid polyether (polyethylene oxide; M.W. = 100,000; POLYOX ® N-10, Union Carbide); 49.9% acrylic resin (poly(methylmethacrylate; M.W. = 153,000 (wt. avg.) E.I. DuPont de Nemours & Co., Inc., Wilmington, DE); 0.1% azelaic acid (Quantum Chemical Corp., Cincinnati, OH)
[3]Air Products and Chemicals, Inc., Allentown, PA
[4]Grade 3203HS, Ashbury Graphite Mill, Ashbury, NJ
[5]Molybdenum low alloy iron powder containing 0.85% dissolved molybdenum; Ancorsteel 85HP; Hoeganaes The powder properties were as follows:

TABLE VII

| Mix | F | G | H | I | J |
|---|---|---|---|---|---|
| Dust Resistance (% C.) | 90 | 96 | 100 | 100 | 98 |
| Flow (Sec/50 g) | 0 | 28 | 27 | 27 | 27 |
| Apparent Density (g/cc) | 3.07 | 3.09 | 2.89 | 2.89 | 2.94 |

The powder mixtures were pressed into 0.25 inch TRS bars at 50 tsi and 145° F. and then sintered at 2050° F. for 30 minutes under dissociated ammonia in a Lucifer Belt Furnace. The results are shown in Table VIII.

TABLE VIII

| Mix | F | G | H | I | J |
|---|---|---|---|---|---|
| Compacted | | | | | |
| Green Density (g/cc) | 7.18 | 7.12 | 7.20 | 7.22 | 7.22 |
| Green Strength (psi) | 2300 | 2500 | 5700 | 5900 | 5000 |
| Green Expansion (%) | 0.24 | 0.24 | 0.26 | 0.23 | 0.20 |
| Stripping Stress (psi) | 3500 | 3300 | 2600 | 3200 | 3900 |
| Sliding Stress (psi) | 2000 | 2400 | 1900 | 3000 | 5700 |
| Sintered | | | | | |
| Density (g/cc) | 7.13 | 7.09 | 7.18 | 7.21 | 7.23 |
| Dimensional Change | 0.112 | 0.024 | 0.070 | 0.073 | 0.031 |
| TRS (hsi) | 151 | 149 | 152 | 163 | 164 |
| Hardness ($R_B$) | 80 | 78 | 81 | 81.5 | 81.2 |
| Carbon (%) | 0.57 | 0.57 | 0.56 | 0.54 | 0.54 |
| Oxygen (%) | 0.037 | 0.044 | 0.039 | 0.044 | 0.043 |

These results show the ability of the binder/lubricant to increase green strength without sacrificing compressibility and lubrication quality at the die wall. The powder mixture containing the binder/lubricant (e.g., Mix H) exhibited improved compressibility and green strength with reduced stripping and sliding pressure when compared to mixtures containing synthetic wax and/or regular binding agent (i.e., Mixes F and G). The sintered density is also increased. The binder/lubricant also burns off cleanly, leaving no ash in the compact or the furnace.

Further reduction of the binder/lubricant to 0.5% (Mix I) showed further improvement in green density and sintered density. However, the sliding pressure increased versus reference Mix G. The stripping pressure is lower than that for Mix F and for Mix G. The green strength is increased to 5900 psi. The increased sintered strength is likely due to the reduced amount of organic material in the compact.

Further reduction of the binder/lubricant to 0.25% (Mix J) resulted in increased stripping pressure and sliding pressures. This indicates that there may be insufficient lubricant available for ejection. The green strength for Mix J is also decreased. This indicates that the green strength may be sensitive to the concentration of binder/lubricant in the green compact.

EXAMPLE 3

Comparison of Binder/Lubricant And Zinc Stearate On Molybdenum/Iron Powder

Mixtures K–N, having the compositions indicated in Table IX, were prepared as described above:

TABLE IX

| Mix | K | L | M | N |
|---|---|---|---|---|
| Zinc Stearate[1] (%) | 1.0 | 0 | 0 | 0 |
| Binder/Lubricant (%) | | | | |
| Solid Polyether[2] | 0 | 0.65 | 0.6 | 0.49 |
| Liquid Polyether[3] | 0 | 0.3 | 0.3 | 0.22 |
| Dibasic[4] | 0 | 0.05 | 0.1 | 0.04 |
| Nickel[5](%) | | 4 | 4 | 4 |
| Copper[6] (%) | 1 | 1 | 1 | 1 |
| Graphite[7] (%) | 0.5 | 0.5 | 0.5 | 0.5 |
| Iron-based Powder[8] (%) | 93.5 | 93.5 | 93.5 | 93.75 |

[1]Mallinkrodt Flowmet Z, Mallinkrodt Specialty Chemical Co., St. Louis, MO.
[2]POLYOX N-10; Union Carbide
[3]Polyglycol 15-200; Dow Chemical
[4]Azelaic acid; Quantum Chemical
[5]INCO123; Inco
[6]Greenback grade 240MD95; Greenback Industries, Inc., Greenback, TN
[7]Grade 3203HS, Ashbury Graphite Mill, Ashbury, NJ
[8]Molybdenum low alloy iron powder containing 0.85% dissolved molybdenum; Ancorsteel 85HP; Hoeganaes The powder mixtures were pressed into 0.25 inch TRS bars at 50 tsi and 145° F. and then sintered at 2050° F. for 30 minutes in a Lucifer Belt Furnace. The results are shown in Table X.

TABLE X

| Mix | K | L | M | N |
|---|---|---|---|---|
| Powder | | | | |
| Dust Resistance | | | | |
| % Carbon | 62 | 100 | 100 | 100 |
| % Nickel | 21 | 96 | 94 | 98 |
| % Copper | 42 | 98 | 90 | 99 |
| Flow (sec/50 g) | None | 30 | 30 | 30 |
| Apparent Density | 3.33 | 2.47 | 2.56 | 2.85 |
| Compacted | | | | |
| Green Density (g/c) | 7.18 | 7.26 | 7.27 | 7.28 |
| Green Strength (psi) | 2300 | 3700 | 3300 | 3900 |
| Green Expansion (%) | 0.26 | 0.20 | 0.20 | 0.26 |
| Stripping Stress (psi) | 3000 | 3800 | 2500 | 4700 |
| Sliding Stress (psi) | 1500 | 1900 | 1000 | 1700 |
| Sintered | | | | |
| Density | 7.17 | 7.18 | 7.20 | 7.23 |
| Dimensional Change | 0.013 | .009 | −.009 | .011 |
| TRS (Ksi) | 235 | 196 | 215 | 238 |
| Hardness ($R_B$) | 93.3 | 96.0 | 96.0 | 96.3 |
| Carbon (%) | 0.50 | 0.50 | 0.50 | 0.50 |
| Oxygen (%) | 0.037 | 0.044 | 0.039 | 0.044 |

As indicated by dust resistance, the binder/lubricant of the invention provided superior bonding capability for nickel, copper, and graphite.

The results also show that binder/lubricant reduces ejection force in terms of stripping stress and sliding stress when compared with zinc stearate. In fact, the sliding pressure is reduced to 66% of that of the zinc stearate mix.

Those skilled in the art will appreciate that numerous changes and modifications can be made to the preferred embodiments of the invention and that such changes and modifications can be made without departing from the spirit of the invention. It is therefore intended that the appended claims cover all such equivalent variations as fall within the true spirit and scope of the invention.

What is claimed is:

1. A metallurgical powder composition comprising iron-based powder admixed with about 0.3 to about 10 weight percent, based on the total composition weight, of a blend that comprises dibasic organic acid and polyether.

2. The composition of claim 1 wherein said dibasic organic acid has a formula:

$$HOOC—R_1—COOH$$

wherein $R_1$ is alkyl or alkenyl having from 1 to about 10 carbon atoms.

3. The composition of claim 2 wherein said dibasic organic acid is oxalic acid, malonic acid, succinic acid, glutaric acid, adipic acid, pimelic acid, suberic acid, azelaic acid, sebacic acid, or combinations thereof.

4. The composition of claim 2 wherein said dibasic organic acid is azelaic acid.

5. The composition of claim 1 wherein said polyether is a solid under ambient conditions.

6. The composition of claim 5 wherein said solid polyether comprises a plurality of subunits of a formula:

$$—[O(CH_2)_q]—$$

Wherein q is from about 1 to about 7.

7. The composition of claim 5 wherein said solid polyether has a formula:

$$H—[O(CH_2)_q]_n—OH$$

wherein q is from about 1 to about 7 and n is selected such that the polyether has a weight average molecular weight greater than about 10,000.

8. The composition of claim 7 wherein q is 2 and n is selected such that the polyether has a weight average molecular weight of about 20,000 or about 100,000.

9. The composition of claim 7 wherein n is selected such that the polyether has a weight average molecular weight of from about 2,000 to about 180,000.

10. The composition of claim 7 wherein n is selected such that the polyether has a weight average molecular weight of about 20,000 or about 100,000.

11. The composition of claim 1 wherein said polyether is a liquid under ambient conditions.

12. The composition of claim 11 wherein said liquid polyether comprises a plurality of subunits of a formula:

$$—[O(CH_2)_q]—$$

wherein q is from about 1 to about 7.

13. The composition of claim 12 wherein q is 2 or 3.

14. The composition of claim 12 wherein the liquid polyether has a weight average molecular weight less than about 8000.

15. The composition of claim wherein said blend further comprises acrylic resin.

16. The composition of claim 15 wherein said acrylic resin contains polymers of acrylic acid or of methacrylic acid.

17. The composition of claim 15 wherein said acrylic resin includes more than one subunit of a formula:

$$—[CH_2—C(H)(R_2)—COOR_3]—$$

wherein $R_2$ is H or methyl, and $R_3$ is H, alkyl or alkenyl having from 1 to about 7 carbon atoms.

18. The composition of claim 17 wherein $R_2$ is H and $R_3$ is H, methyl, or butyl.

19. The composition of claim 1 further comprising a plasticizer.

20. The composition of claim 19 wherein said plasticizer is an ester of phthalic acid, phosphoric acid, or dibasic acid.

21. The composition of claim 1 further comprising alloying powder.

22. The composition of claim 21 wherein said alloying powder comprises graphite.

23. The composition of claim 21 wherein said alloying powder constitutes from about 0.01 to about 3 weight percent of said composition.

24. The composition of claim wherein blend constitutes from about 0.3 to about 3.0 weight percent of the composition.

25. The composition of claim 1 wherein blend constitutes from about 0.8 to about 1.2 weight percent of the composition.

26. The composition of claim 1 wherein the blend comprises from about 1 to about 10 weight percent dibasic organic acid.

27. The composition of claim 1 wherein the blend comprises from about 50 to about 90 weight percent of a polyether that is a solid under ambient conditions.

28. The composition of claim i wherein the blend comprises from about 5 to about 50 weight percent of a polyether that is a liquid under ambient conditions.

29. The composition of claim wherein the blend comprises from about 5 to about 50 weight percent acrylic resin.

30. The composition of claim wherein the blend comprises:

(a) dibasic organic acid; and a polyether that is a solid under ambient conditions; or (b) dibasic organic acid; a polyether that is a solid under ambient conditions; and a polyether that is a liquid under ambient conditions; or (c) dibasic organic acid; a polyether that is a solid under ambient conditions; a polyether that is a liquid under ambient conditions; and a acrylic resin; or (d) dibasic organic acid; a polyether that is a solid under ambient conditions; and an acrylic resin; or (e) dibasic organic acid; a polyether that is a liquid under ambient conditions; and an acrylic resin.

31. A shaped article prepared by compacting the composition of claim 1 in a die.

32. A shaped article prepared by compacting the composition of claim 1 in a die and sintering the resultant compact.

* * * * *

UNITED STATES PATENT AND TRADEMARK OFFICE

CERTIFICATE OF CORRECTION

PATENT NO. : 5,290,336

DATED : March 1, 1994

INVENTOR(S) : Sydney Luk

It is certified that error appears in the above-identified patent and that said Letters Patent is hereby corrected as shown below:

Column 5, line 10; after from about "i" should read -- 1 --

Column 5, line 59; "dibasio" should read -- dibasic --

Column 10, Table IX, in column K; after "Nickel[5](%) insert -- 4 --

Column 12, claim 15; after "claim" insert -- 1 --

Column 12, claim 24; after "claim" insert -- 1 --

Column 12, claim 28; after claim "i" should read -- 1 --

Column 12, claim 30; after "claim" insert -- 1 --

Signed and Sealed this

Twentieth Day of December, 1994

*Attest:*

Bruce Lehman

BRUCE LEHMAN

*Attesting Officer*

*Commissioner of Patents and Trademarks*